US005412867A

United States Patent [19]

Aikawa et al.

[11] Patent Number: 5,412,867

[45] Date of Patent: May 9, 1995

[54] METHOD OF JOINING FLAT ELECTRODES

[75] Inventors: Noboru Aikawa, Ibaragi; Koji Matsuo, Katano; Yutaka Nishimura, Kadoma; Hiroshi Iwamoto, Osaka; Tokuhisa Komatsu, Takatsuki, all of Japan

[73] Assignee: Matsushita Electric Industrial Co., Ltd., Japan

[21] Appl. No.: 66,224

[22] Filed: May 25, 1993

[30] Foreign Application Priority Data

May 25, 1992 [JP] Japan ..... 4-132156
Oct. 6, 1992 [JP] Japan ..... 4-266942

[51] Int. Cl.[6] ..... H01R 43/00

[52] U.S. Cl. ..... 29/825; 65/138; 156/89; 156/230; 264/61

[58] Field of Search ..... 29/825; 156/230, 89; 65/138, 155; 264/61

[56] References Cited

U.S. PATENT DOCUMENTS

| | | | |
|---|---|---|---|
| 4,586,976 | 5/1986 | Takano et al. | 156/233 |
| 4,959,008 | 9/1990 | Wasulko | 156/230 X |
| 4,985,098 | 1/1991 | Kohno et al. | 156/89 |
| 5,049,434 | 9/1991 | Wasulko | 156/230 X |

FOREIGN PATENT DOCUMENTS 3-221415 3/1993 Japan .

*Primary Examiner*—Carl J. Arbes
*Attorney, Agent, or Firm*—Wenderoth, Lind & Ponack

[57] ABSTRACT

The present invention intends to provide a gap-forming sheet for laminating a plurality of flat plate electrodes, for example, for controlling electron beam at high accuracy in a short period of time. Gap-forming sheets each including a support member formed by depolymerizing resin, gap members for providing gaps between the flat plate electrodes, and a bonding paste for bonding the flat plate electrodes, are held between the flat plate electrodes, which are baked to decompose the support members, and thus, by melting the bonding paste, the flat plate electrodes are joined together for lamination, with gaps being provided by the gap members.

1 Claim, 5 Drawing Sheets

METHOD OF JOINING FLAT ELECTRODES

BACKGROUND OF THE INVENTION

1. Field of the Invention

The present invention generally relates to a gap-forming device and more particularly, to a gap-forming sheet used for bonding a plurality of substrates or flat electrodes through predetermined intervals therebetween by pressing and heating the substrates, with gap members and bonding/fixing members being disposed between the substrates, and a method of manufacturing the gap-forming sheet of the above described type, and also, a method of joining flat electrodes by using said gap-forming sheet.

Conventionally, in a flat-face type display device utilizing an electron beam, it has been attempted to effect lamination of control electrodes by joining a plurality of flat electron beam control electrodes through a predetermined interval at high accuracy in a state electrically insulated from each other in order to reduce thickness of the device. In the arrangement as referred to above, the electron beam emitted from the cathode is deflected in vertical and horizontal directions by the laminated control electrodes so as to illuminate fluorescent materials formed at predetermined positions on a screen for displaying images. In this case, the intervals to be formed between the respective electrode substrates must be uniform over the entire surface of the electrode, with curving and undulation being suppressed to minimum, while a perfectly insulated state is maintained.

Referring to the drawings, one example of the electrode construction in the conventional flat-face type display device referred to above will be described hereinbelow.

FIG. 6(*a*) is a side sectional diagram showing a general construction of a conventional flat laminated electrodes, and FIGS. 6(*b*) and 6(*c*) are also side sectional diagrams for explaining a manufacturing method of the conventional flat laminated electrodes.

As shown in FIG. 6(*a*), the conventional laminated electrodes include for example, four flat electrodes 4*a* to 4*d*, and spacing or gap members 2 and glass members 13 for bonding disposed at high positional accuracy between the respective substrates as illustrated.

For manufacturing the known laminated electrodes as referred to above, the gap members 2 having uniform thickness for maintaining a proper interval between the flat electrodes 4*a* and 4*b* and the bonding glass members 13 for joining said electrodes 4*a* and 4*b* are first disposed on the flat electrode 4*a* as shown in FIG. 6(*b*). For the gap members 2, a rod material of glass or ceramics, etc. which is a heat resistant insulator with a high melting point is employed, while, for the bonding glass members 13, an insulator such as a glass rod material with a low melting point, etc. may be used. Thereafter, as shown in FIG. 6(*c*), the flat electrodes 4*b*, 4*c* and 4*d* prepared in the similar manner are overlapped on the flat electrode 4*a* through accurate positioning, whereby the plurality of flat electrodes 4*a* to 4*d* are piled one upon another, with the gap members 2 and the joining glass materials 13 held therebetween. Then, by applying a uniform depressing force over the entire surface of the flat electrodes 4*a* to 4*d* so that said electrodes 4*a* to 4*d* may not be deformed by heat during processing, baking is effected at a temperature above the melting point of the bonding glass members 13. By such baking, the bonding glass members 13 are melted for joining the flat electrodes 4*a* and 4*b* located at the upper and lower portions, while the gaps can be formed by the thickness of the gap members 2, and ultimately, the laminated electrodes as shown in FIG. 6(*a*) are obtained for application as the electron beam control electrode of the flat face display device.

In the manufacturing method of the conventional laminated electrodes as described so far, however, it is required to repeatedly arrange the plurality of small sized gap members and the bonding glass members 13 on the flat electrode substrates 4*a* to 4*c* through accurate positioning, and therefore, not only high accuracy is necessary for the processing, but working time tends to become longer, with a consequent reduction in the mass productivity. Moreover, since the above arranging work must be repeatedly effected on the laminated substrates, dust and soiling substances tend to adhere onto the surfaces of the substrates, thus resulting in a large factor for lowering yield.

2. Description of the Prior Art

SUMMARY OF THE INVENTION

Accordingly, an essential object of the present invention is to provide a gap-forming sheet for obtaining 10 laminated electrodes having stable gaps therebetween at high accuracy through a simple process suitable for mass production, in the joining of flat electrode substrates to be used for a flat-face type display device, etc.

Another object of the present invention is to provide a method of efficiently manufacturing the gap-forming sheet of the above described type, and also a joining method of flat electrodes to be employed therefor.

In accomplishing these and other objects, according to one aspect of the present invention, it is so arranged that, on the surface of a support member formed into a sheet-form by using as a binder, a depolymerising resin which may completely disappear upon heating at a temperature above a heat decomposition temperature, or on the surface of a support member in the form of a sheet formed with a parting layer or free tackness layer (referred to as a parting layer hereinafter), gap members of an insulative nature capable of maintaining a stable shape against heat are disposed. As a method of arranging the gap members on the support member, the gap members are uniformly dispersed in a printing ink having a heat fusing material as a binder, and by using said ink, the gap members are arranged on the surface of the support member in any desired patterns, for example, by a printing technique such as the screen printing, intaglio printing, etc. or by scraping off the printing ink with a doctor blade formed with slits each having a width equivalent to one or two gap members. Otherwise, by evenly forming an adhesive film layer on the support member by painting, gap members are uniformly arranged on said adhesive film, by utilizing, for example, mesh holes of a screen plate or the like, and thereafter, the heat fusing material formed into an ink is formed on the surfaces of the gap members. The support member formed with the gap members by such method is depressed onto the surface of the flat electrode. In the case where the support member is formed by the depolymerizing resin, other flat electrode is overlapped so as to hold both the support member and the gap members therebetween. Alternatively, after depressing the support member onto the flat electrode, the support member is separated from the gap members so as to form only the gap members on the flat electrode, and then, another flat electrode is overlapped to hold the gap members therebetween. By repeating such steps by he desired number of times, the laminated electrodes are formed by holding only the support member or the gap members. The support member held between the substrates disappears by being heated up to a temperature above the heat decomposition temperature, while the heat fusing material mixed in the ink is softened to be melted for making it possible to completely join the substrates as desired.

By the above practice, it is possible to arrange a plurality of gap members on the surface of one sheet corresponding to the size of the flat electrode continuously at high accuracy, and therefore, continuous productivity and positional accuracy of the gap members may be improved. Moreover, by inserting said sheet between the flat electrodes or transferring the gap members formed on the surface of the sheet, onto the surface of the flat electrode, the gap members can be formed collectively, and thus, reduction of working time, and high efficiency may be achieved, while handling of parts during manufacture is facilitated for the improvement of yield.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1A:
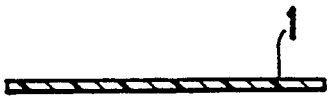
FIGS. 1(*a*) to 1(*e*) are side sectional diagrams for explaining a method of manufacturing laminated electrodes using gap-forming sheet according to one preferred embodiment of the present invention, FIG. 1(*f*) is a side sectional view of the laminated electrodes manufactured by the method of FIGS. 1(*a*) to 1(*e*), FIGS. 2(*a*) to 2(*c*) are side sectional diagrams for explaining a method of manufacturing a gap-forming sheet according to a second embodiment of the present invention.
Figure 1B:
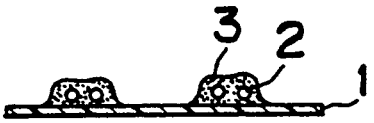
Figure 1C:
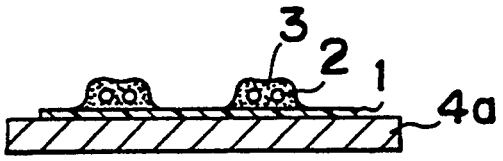
Figure 1D:
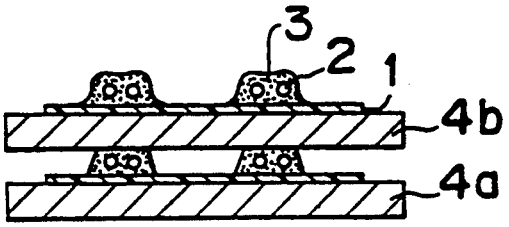
Figure 1E:
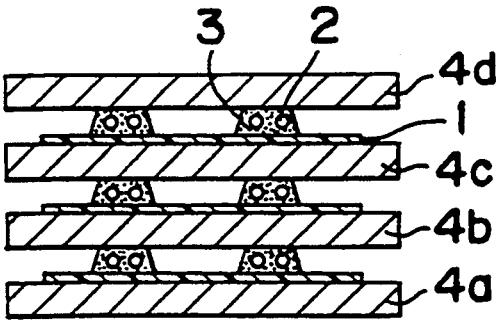
Figure 1F:
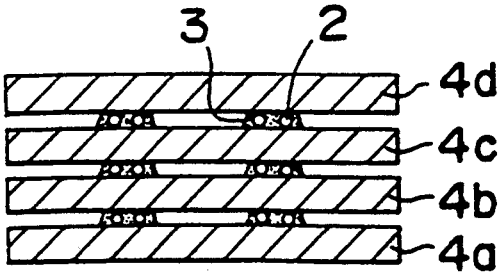

Before the description of the present invention proceeds, it is to be noted here that like parts are designated by like reference numerals throughout the accompanying drawings.

Referring now to the drawings, there are shown in FIGS. 1(*a*) to 1(*e*), side sectional diagrams for explaining a method of manufacturing laminated electrodes using gap-forming sheets according to one preferred embodiment of the present invention, and the laminated electrodes constructed by the above manufacturing method are illustrated in the side sectional view in FIG. 1(*f*).

In FIGS. 1(*a*) to 1(*e*), the laminated electrodes include flat electrodes 4*a* to 4*d*, support sheets 1 provided on the respective electrodes 4*a* to 4*c*, and paste materials 3 for bonding, containing gap members 2 and provided on the support sheets 1 for spacing between the electrodes 4*a* and 4*b*, 4*b* and 4*c*, and 4*c* and 4*d* as illustrated in the manner as described hereinbelow.

Referring particularly to FIGS. 1(*a*) to 1(*e*), the manufacturing method of the laminated electrodes employing the gap-forming sheet according to the present invention will be described hereinafter. The support member 1 as shown in FIG. 1(*a*) is composed of a depolymerizing resin such as PVC (polyvinyl alcohol), polyethylene, acrylic resin or the like which will be subjected to complete thermal decomposition during baking and formed into the form of a sheet of 30 μm in thickness. It is preferable that the support member 1 should have a thickness as thin as possible, and is free from dimensional variation by expansion and shrinkage. Then, as shown in FIG. 1(*b*), layers or paste material 3 for bonding containing gap members 2 therein are formed on the surface of the support member 1. The paste material 3 is produced in such a manner that, in a paste prepared by mixing 10% of a depolymerizing resin e.g. IDMA(isodecimethacrylate) as a binder, into crystallized glass powder to act as a heat fusion material, glass beads of selected particle diameter of 425 μm equal to the required gap amount between the electrodes are uniformly dispersed as the gap members 2. In the above embodiment, although 10% of IDMA is added with respect to the glass powder, it is preferable to adjust the amount of addition according to viscosity thereof during use as a paste, and kinds of glass powder, etc. With respect to the glass bead diameter, there was observed a tendency towards better dispersion as the particle diameter becomes small. Meanwhile, in the present embodiment, although the glass beads are described as employed for the gap members, such glass beads may be replaced by beads of other heat resistant insulating material such as ceramics or the like depending on necessity.

The bonding paste material 3 containing the gap members 2 is formed into layers or patterns at predetermined position on the surface of the support member 1 by a method superior in a mass productivity, and capable of realizing a high printing accuracy such as the screen printing, intaglio printing or the like, and thus, the sheet for the gap formation is formed. Thereafter, as shown in FIG. 1(*c*), the support member 1 formed with the layers of the bonding paste material 3 containing gap members 2 is overlapped at the predetermined position on the surface of the flat electrode 4*a* through positioning at high accuracy. By overlapping the flat electrodes 4b, 4c and 4d onto the flat electrode 4a through positioning as shown in FIG. 1(*d*), it becomes possible to laminate the electrodes (FIG. 1(*e*)). Subsequently, by uniformly pressurizing the entire surfaces of the electrodes thus laminated and heating said electrodes up to a temperature above the softening point of the bonding paste material 3 and the heat decomposing temperature of the support member 1, the support member 1 disappears by decomposition, while the flat electrodes 4a to 4d are bonded to each other, and thus, the laminated electrodes having the gap amount of 425 μm equal to the particle diameter of the glass beads can be obtained as shown in FIG. 1(*f*).

It is to be noted here that in the foregoing embodiment, although the bonding paste material 3 is directly printed onto the surface of the support member 1 during printing onto the support member 1, it may be so modified, for example, to preliminarily form layers of an adhesive material, for example, by a technique such as a spin coat or roll coat, etc. on the entire surface or only at the required portions of the support member 1 for improvement of printing property and stability of patterns (not shown). The adhesive material referred to above is one composed by a depolymerizing resin, and is adapted to be completely decomposed and disappear together with the support member 1 during heating at the bonding of the electrodes. (Second embodiment)

Figure 2A:
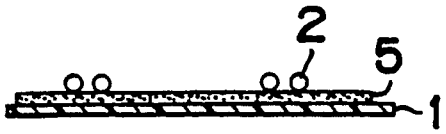
Figure 2B:
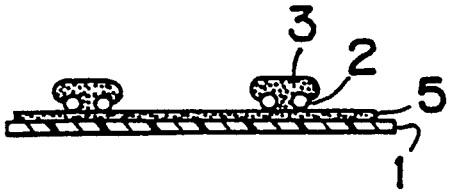
Figure 2C:
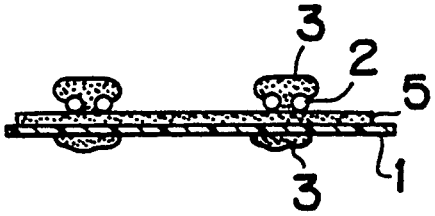

FIGS. 2(*a*) to 2(*c*) show a method of manufacturing a gap-forming sheet according to a second embodiment of the present invention.

According to this embodiment, a layer of an adhesive material 5 is preliminarily formed on the surface of the support member 1, and only the gap members 2 are arranged at high accuracy at predetermined positions on the surface of the layer of the adhesive material 5 as shown in FIG. 2(*a*). For the arrangement of the gap members 2, there are such methods as an electrostatic arrangement, and an arrangement through mesh holes of a screen plate. Then, as shown in FIG. 2(*b*), by applying the bonding paste material 3 onto the surfaces of the gap members 2, a gag forming sheet having the similar effect as in the first embodiment is formed. According to the present embodiment, dispersion of the gap members into the bonding paste material is not necessary, and it becomes possible to positively dispose the gap members at predetermined positions between the flat electrodes. Moreover, as shown in FIG. 2(*c*), by forming layers of the bonding paste material 3 at the reverse surface side of the sheet through the gap members 2 on the support member for lamination bonding, the bonding strength between the flat electrodes can be increased. (Third embodiment)

Figure 3:
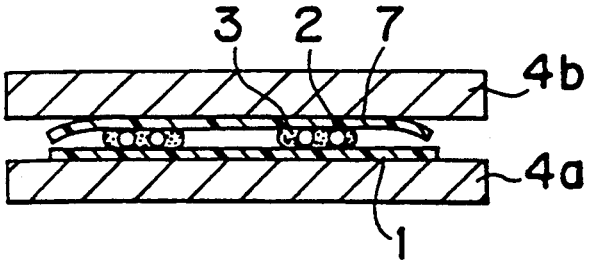
FIG. 3 is a side sectional diagram for explaining a method of manufacturing a gap-forming sheet according to a third embodiment of the present invention, FIGS. 4(*a*) to 4(*e*) are side sectional diagrams for explaining a method of manufacturing laminated electrodes using gap-forming sheets according to a fourth embodiment of the present invention, FIG. 4(*f*) is a side sectional view of the laminated electrodes manufactured by the method of FIGS. 4(*a*) to 4(*e*), FIGS. 4(*g*) and 4(*h*) are perspective views for further explaining the method of manufacturing laminated electrodes using the gap-forming sheet of the present invention, FIGS. 5(*a*) and 5(*b*) are sectional diagrams for explaining a method of manufacturing laminated electrodes using gap-forming sheets according to a fifth embodiment of the present invention.
Figure 4A:
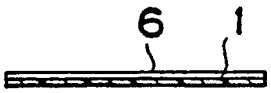
Figure 4B:
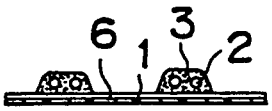
Figure 4C:
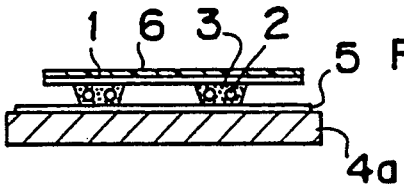
Figure 4D:
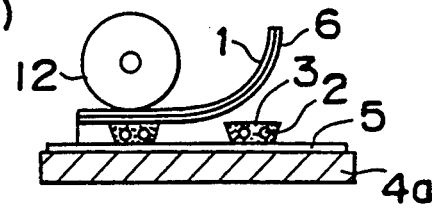
Figure 4E:
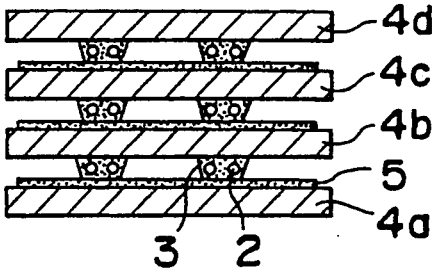
Figure 4F:
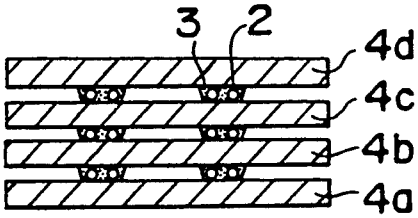
Figure 4G:
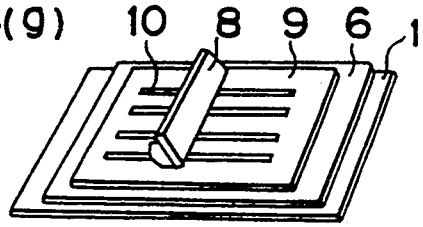
Figure 4H:
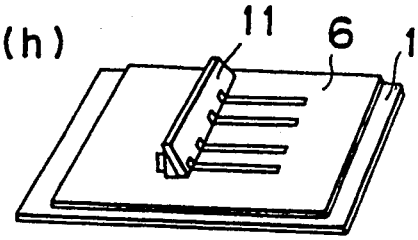

FIG. 3 shows a sectional diagram for explaining another embodiment of a manufacturing method of the gap-forming sheet according to the present invention.

In the gap forming sheet as prepared in the first and second embodiments described above, by arranging to overlap another support member 7 of the same quality as the support member 1 onto the gap members 2 and the bonding paste material 3 formed on said support member 1 so as to hold said gap members and the paste material 3 therebetween as shown in FIG. 3, wettability of the flat electrodes 4a, 4b, the support member 1, and the holding support member 7 is improved, and higher bonding strength between the flat electrodes can be realized. (Fourth embodiment)

Referring further to FIGS. 4(*a*) to 4(*e*), there is shown a manufacturing method of the laminated electrodes using the gap-forming sheet according to the present invention, while FIG. 4(*f*) denotes the construction of the laminated electrodes constituted by the manufacturing method of the present invention. FIGS. 4(*g*) and 4(*h*) are schematic perspective views for explaining a method of forming the gap-forming members on the support member.

Subsequently, the method of manufacturing the gap-forming sheet according to the fourth embodiment of the present invention will be explained with reference to FIGS. 4(*a*) to 4(*h*).

As shown in FIG. 4(*a*), on a support member 1 of 25 to 50 μm in thickness, and composed for example, of a material such as PET or the like, a free tackness layer or parting layer 6 (referred to as parting layer hereinafter) is uniformly formed in the thickness of 0.5 to 1.5 μm. The support member 1 has a property small in the generation of dimensional variation by expansion and contraction and stable against influence by heat. Subsequently, as shown in FIG. 4(*b*), bonding paste materials 3 containing gap members 2 therein are formed on the surface of the parting layer 6. For the paste material 3, a mixture of a depolymerizing resin into crystallized glass powder is employed, with glass beads acting as gap members 2 being uniformly dispersed therein.

For forming the bonding paste materials 3 onto the parting layer 6, it may be so arranged that, for example as shown in FIG. 4(*g*), a masking plate 9 formed with through-slits by etching is brought into contact with the surface of the parting layer 6, and the bonding paste material 3 is filled into the slits 10 by squeezing with a doctor blade 8, whereby required patterns can be formed on the parting layer 6 by separating the masking plate 9 from the surface of the parting layer 6. According to proper selection of the thickness of the masking plate 9 and the width of the slits 10, it becomes possible to stably form patterns superior in linearity as well as to properly control the width and thickness of the patterns.

Although the pattern forming method by the use of the masking plate is described in the above embodiment, it is also possible to modify the method so as to form patterns on the predetermined position on the surface of the parting layer 6 by scraping off the bonding paste material 3 by a doctor blade 11 formed with slits at its forward edge as illustrate in FIG. 4(*h*). Moreover, it is also fully possible to employ the screen printing, intaglio printing, etc. which are superior in the mass productivity, and capable of forming patterns at high accuracy. By the practice as explained earlier, sheet formation of the gap members is first effected. Then, as shown in FIG. 4(*c*), onto the predetermined position on the surface of the flat electrode 4a formed with an adhesive member 5 having a thickness in the range of 0.5 to 2 μm for obtaining stronger bonding strength between the electrodes and stability during electrode lamination, the support member 1 was overlapped through positioning at high accuracy. For the adhesive material 5, the depolymerizing resin or the like which will be completely decomposed during baking is employed. Then, as shown in FIG. 4(*d*), by separating the support member 1, while applying a constant depressing force onto the surface of the support member 1 by a depressing roller 12, only the bonding paste material 3 containing the gap members 2 is transferred onto the surface of the flat electrode 4a by the combined action of the adhesion of the adhesive material 5 and the free thickness of the parting layer 6. Although the adhesive material 5 used for the embodiment is one having a sufficient adhesion in the normal temperature, such adhesive material may be replaced by that of a type presenting adhesive effect during heating by taking its workability into consideration. The flat electrodes 4*b*, 4*c* and 4*d* prepared in the similar manner are piled upon the flat electrode 4*a* through positioning as shown in FIG. 4(*e*), and thus, it becomes possible to laminate the electrodes. By uniformly pressing the entire surface of the laminated electrodes, and heating up to temperatures above the softening point of the bonding paste 3 and decomposing temperature higher than the adhesive material, the adhesive layer 5 disappears by decomposition, while the laminated electrodes having the gap amount equal to the particle diameter of the glass beads is obtained by bonding the flat electrodes to each other as shown in FIG. 4(*f*).

(Fifth embodiment)

Figure 5A:
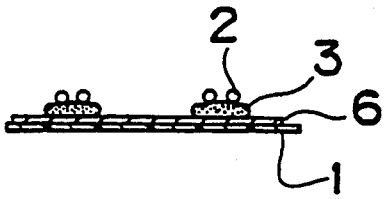
Figure 5B:
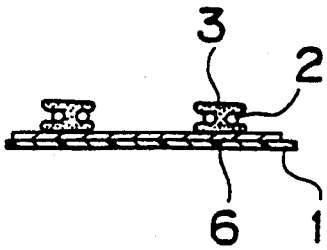
Figure 6A:
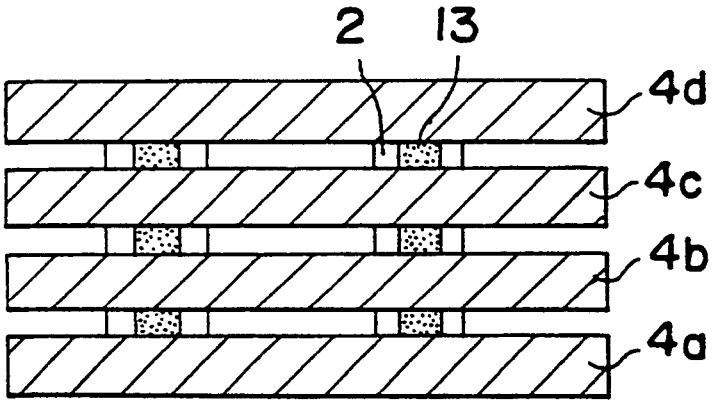
FIG.6(a) PRIOR ART
FIG. 6(*a*) is a side sectional view showing constructions of a conventional flat laminated electrodes (already referred to), and FIG. 6(*b*) and 6(*c*) are sectional diagrams for explaining a method of manufacturing in the conventional flat laminated electrodes of FIG. 6(*a*) (already referred to).
Figure 6B:
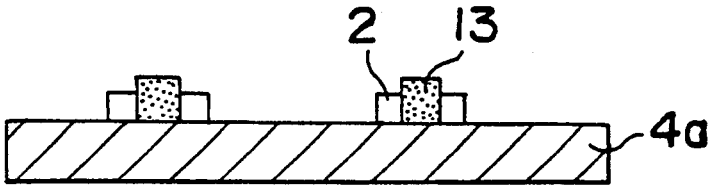
FIG.6(b) PRIOR ART
Figure 6C:
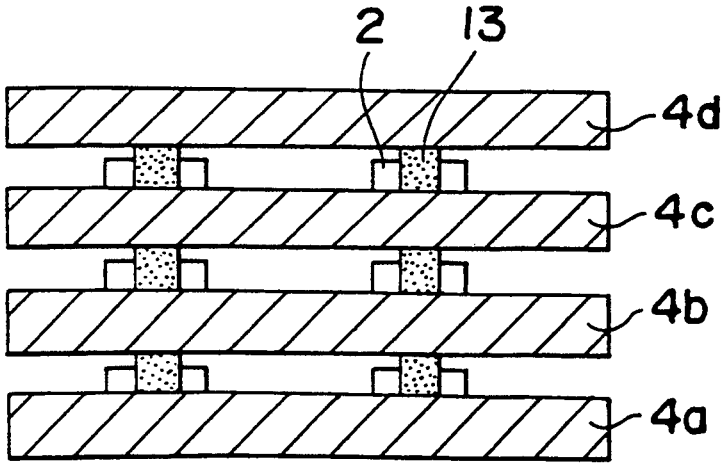
FIG.6(c) PRIOR ART

FIGS. 5(*a*) and 5(*b*) show a further embodiment of a manufacturing method of the gap-forming sheet according to the present invention.

As shown in FIG. 5(*a*), in this embodiment, at required positions on the surface of the support member 1 formed with the parting layer 6, patterns only of the bonding paste material 3 are first formed, and then, only the gap members 2 are disposed at high accuracy on the surface of the bonding paste material 3. For disposing the gap members 2 in the above case, there are available such methods as the electrostatic arrangement, and arrangement through mesh holes of a screen plate, etc. Thereafter, as shown in FIG. 5(*b*), by again forming bonding paste material 3 on the surfaces of the gap members 2, the gap-forming sheet having the similar effect as that in the fourth embodiment may be constructed. By the present embodiment, it is not necessary to disperse the gap members in the bonding paste material 4, and still, the gap members 2 can be positively arranged at the predetermined positions between the flat electrodes.

As is clear from the foregoing description, according to the present invention, it becomes possible to arrange the gap members collectively between the flat electrodes as required, and therefore, not only the working time is reduced to a large extent for improvement of the mass productivity, but handling of the product is facilitated, since the gap members are formed on the sheet, and thus, mixing of dust or the like during assembly of the electrodes may also be advantageously prevented.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A method for manufacturing a laminated electrode for controlling electron beams, in which a plurality of flat electrodes are bonded to each other through predetermined intervals, said method comprising the steps of:

a. positioning on a first flat glass electrode, a support member having a paste pattern thereon, the paste of said paste pattern composed of glass beads, bonded glass powder and a binder of a depolymerizing resin of PVA, polyester or acrylic resin;

b. positioning on said paste pattern, a second glass electrode positioned so as to overlap said first glass electrode;

c. repeating steps a. and b. to form an assembly comprising a desired number of overlapping glass electrodes;

d. heating said assembly of overlapping glass electrodes so as to soften the bonding glass powder therebetween, thereby laminating and joining said flat electrodes, spaced apart at predetermined intervals by a layer comprising said glass beads.

* * * * *

UNITED STATES PATENT AND TRADEMARK OFFICE

CERTIFICATE OF CORRECTION

PATENT NO. : 5,412,867

DATED : May 9, 1995

INVENTOR(S) : Noboru AIKAWA et al.

It is certified that error appears in the above-indentified patent and that said Letters Patent is hereby corrected as shown below:

On the title page, item [75]: Inventors, change the secoond inventors name from "Koji" to --Kohji--.

Signed and Sealed this

Twenty-eighth Day of November 1995

*Attest:*

*Attesting Officer*

BRUCE LEHMAN

*Commissioner of Patents and Trademarks*